US008087928B2

(12) United States Patent
Horn et al.

(10) Patent No.: US 8,087,928 B2
(45) Date of Patent: Jan. 3, 2012

(54) LAMINAR FLOW JETS

(76) Inventors: Wallace E. Horn, Mansfield, PA (US); William A. Horn, Mansfield, PA (US)

( * ) Notice: Subject to any disclaimer, the term of this patent is extended or adjusted under 35 U.S.C. 154(b) by 336 days.

(21) Appl. No.: 12/410,934

(22) Filed: Mar. 25, 2009

(65) Prior Publication Data

US 2010/0248174 A1 Sep. 30, 2010

(51) Int. Cl.
*F23C 7/00* (2006.01)

(52) U.S. Cl. ..... 431/187; 239/416.4; 239/416.5; 239/424

(58) Field of Classification Search ..... 431/187; 239/416.4, 416.5, 424
See application file for complete search history.

(56) References Cited

U.S. PATENT DOCUMENTS 1,424,163 A * 8/1922 Harris ..... 239/424.5
1,444,263 A * 2/1923 Mustee ..... 239/424
1,721,381 A * 7/1929 Ellis ..... 239/425
1,978,477 A * 10/1934 Robertson ..... 431/349
2,095,065 A * 10/1937 Hays ..... 431/7
2,143,993 A * 1/1939 McConnell ..... 239/424
2,369,236 A * 2/1945 Jaros ..... 431/179
2,702,080 A * 2/1955 Gee ..... 239/132.3
2,911,035 A * 11/1959 Nieman et al. ..... 239/549
3,204,682 A * 9/1965 Teleshefsky et al. ..... 239/549
3,291,190 A * 12/1966 Radley ..... 239/394
3,407,561 A * 10/1968 Peacock ..... 52/656.9
3,690,564 A * 9/1972 Futerko ..... 239/424.5
3,718,426 A * 2/1973 Harris ..... 31/328
4,756,685 A * 7/1988 Davies et al. ..... 431/160
5,112,219 A 5/1992 Hiemstra
5,163,830 A 11/1992 Pfefferkorn
5,339,635 A * 8/1994 Iwai et al. ..... 60/733
5,494,437 A 2/1996 Kubota et al.
5,516,344 A * 5/1996 Corrigan ..... 48/127.9
5,554,022 A 9/1996 Nabors, Jr. et al.
5,803,725 A 9/1998 Horn et al.
5,814,121 A 9/1998 Travis
5,904,475 A 5/1999 Ding
6,050,809 A 4/2000 Fayerman
6,065,961 A * 5/2000 Shaffer et al. ..... 431/328
6,074,197 A 6/2000 Philippe
6,132,204 A 10/2000 Snyder et al.
6,277,323 B1 8/2001 Bissonnette
6,293,784 B1 9/2001 Griffioen
6,325,618 B1 * 12/2001 Benz et al. ..... 431/187
6,733,282 B2 5/2004 Long
6,755,024 B1 * 6/2004 Mao et al. ..... 60/776
6,824,453 B1 * 11/2004 Andersson ..... 451/102
6,951,454 B2 10/2005 Sarv et al.
7,063,527 B2 * 6/2006 Clifford et al. ..... 431/326
7,094,049 B2 8/2006 Mizuno et al.
7,549,788 B2 * 6/2009 Fujiwara et al. ..... 366/336
2004/0187526 A1 * 9/2004 Shirota et al. ..... 65/531
2004/0213083 A1 * 10/2004 Fujiwara et al. ..... 366/336

* cited by examiner

*Primary Examiner* — Kenneth Rinehart
*Assistant Examiner* — Jorge Pereiro
(74) *Attorney, Agent, or Firm* — Gore & Associates, PLLC

(57) ABSTRACT

A burner head is constructed with adjacent gas delivery tubes of different geometric cross-section shapes which are mechanically held in place radially. The tubes touch in a longitudinal direction at points along their respective inner and outer circumferences so that precise axial alignment whether coaxial or axially offset, is achieved while preserving the necessary laminar gas flow. This configuration greatly speeds the production time which allows economical burners to be produced even when a greater number of faceplate jets is desired. The tube-to-tube contact is also beneficial to the operation of the burner by providing a heat transfer path away from the innermost tube, which prevents overheating. Examples of the simplest geometric tube shapes employed are, for example, a square within a circle, or conversely, a circle within a square.

5 Claims, 6 Drawing Sheets

LAMINAR FLOW JETS

FIELD OF THE INVENTION

This invention relates to laminar fluid flow delivery systems and in particular, to gas burners ("torches") used mainly in the glass and quartz working industries but also in other industrial fields. More specifically, it relates to the construction of the tubular coaxially gas-delivering jets which terminate at the surface at the face of the burner where the flame first occurs.

BACKGROUND OF THE INVENTION

Gas burners are commonly used in the industrial arts for producing a very hot flame to hand work material such as glass and quartz. These devices are also used by jewelers, metal workers and silversmiths. They can also have other uses such as for heating plastics. These are predominantly bench type and handheld burners with a faceplate where the fuel jets exit the burner at the base of the flame. The construction of these burners is similar to the burner marketed by American gas Furnace as shown in FIGS. 1 and 2.

Referring now to FIGS. 1 and 2, burners of this type require concisely aligned concentric tubing 38 in combination with faceplate hole jets 32 to deliver individual gases to the faceplate 34. One gas such as Hydrogen is delivered to faceplate jets 32 from chamber 30 around tubes 38. Each tube is free-standing being held only at one end extending from chamber 36 through which a second gas such as Oxygen is delivered. Obtaining the exact alignment and axial concentricity of the tubes in burners such as this requires a difficult manufacturing process but is essential to establishing a laminar gas flow that produces a high quality and efficient flame (i.e. producing no unburned gases). Also, the cost of production is increased greatly when one desires a greater number of faceplate jets.

There is therefore a need in the art for a surface mix burner jet structure and method of manufacture which provides the necessary coaxially or axially offset disposed tubing while saving labor and therefore providing an economical burner while maintaining the desired high quality and variable flame characteristics.

SUMMARY OF THE INVENTION

In order to meet a need in the art for a precisely manufactured burner of the above described type, the present burner has been devised. According to the invention, a burner head is constructed with adjacent gas delivery tubes of different geometric cross-section shapes which are mechanically held in place radially. The tubes touch in a longitudinal direction at points along their respective inner and outer circumferences so that precise axial alignment whether coaxial or axially offset, is achieved while preserving the necessary laminar gas flow. This configuration greatly speeds the production time which allows economical burners to be produced even when a greater number of faceplate jets is desired. The tube-to-tube contact is also beneficial to the operation of the burner by providing a heat transfer path away from the innermost tube, which prevents overheating.

Examples of the simplest geometric tube shapes employed are, for example, a square within a circle, or conversely, a circle within a square. In the former case, the outside diagonal dimension of the square is almost equal to the inside diameter of the surrounding circular tube so that the abutment of the tubes along the outside of the corners of the square ensures precise coaxial alignment without requiring the precision assembly necessary to hold two coaxial, non-touching circular tubes such that each tube is held precisely centered by its end, a position necessary to maintain the evenness of the laminar gas flow as seen in the prior art. In accordance with the invention, the latter example of a square tube surrounding a circular tube provides a direct mechanical means through radial interference to maintain the desired coaxial alignment of the tubes. In this case, the outside of the circular tube is dimensioned to be equal to the inside dimension of the surrounding square tube between opposite sides. The two tubes therefore are in contact at lines along four points around the circumference of the circular inner tube, where they meet the inside walls of the outer square tube. In either case, the alignment is maintained by direct mechanical contact between the tubes along their sides rather than holding them in non-contacting relation by a supporting structure at end points of the tubes as in the prior art. It will be readily understood therefore that the present system provides a much more economical means of producing a pair of axially positioned gas jets. It has also been found that the flame characteristics are improved and carbon-buildup is reduced.

More specifically, the Applicant has invented a means for providing the laminar axial flow of different combined fluids comprising a first fluid conduit tube having a first cross-sectional shape and a second fluid conduit tube having an arcuate cross-sectional shape wherein longitudinal points along an inside wall of one of said tubes are in contact with longitudinal points along a outside wall of the other tube for radially maintaining axial alignment along their length. The space between said tubes is a conduit for one of said fluids. At a faceplate, the tubes open to the surrounding atmosphere at a common longitudinal terminus where the fluids are combined.

In one embodiment of the invention, a gas burner for producing a flame comprises a head portion including a faceplate being the terminus of a plurality of elongate axially aligned gas delivery tubes. At least two of said tubes deliver two different types of fuel to said faceplate. A first tube has a first polygonal cross-sectional shape and a second tube has an arcuate cross-sectional shape. Longitudinal points along an inside wall of the first tube are in contact along a longitudinal line on an outside wall of the second tube for maintaining the axial alignment of the tubes.

In order to provide yet greater economies of producing the present invention, an alternate embodiment of the invention employs faceplate inserts to provide the desired non-circular geometric shape so that each non-circular shape does not have to be individually cut out of the faceplate material.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention. These and other constructions will become obvious to those skilled in the art from the following drawings and description of the preferred embodiment.

DESCRIPTION OF THE PREFERRED EMBODIMENT

Figure 3:
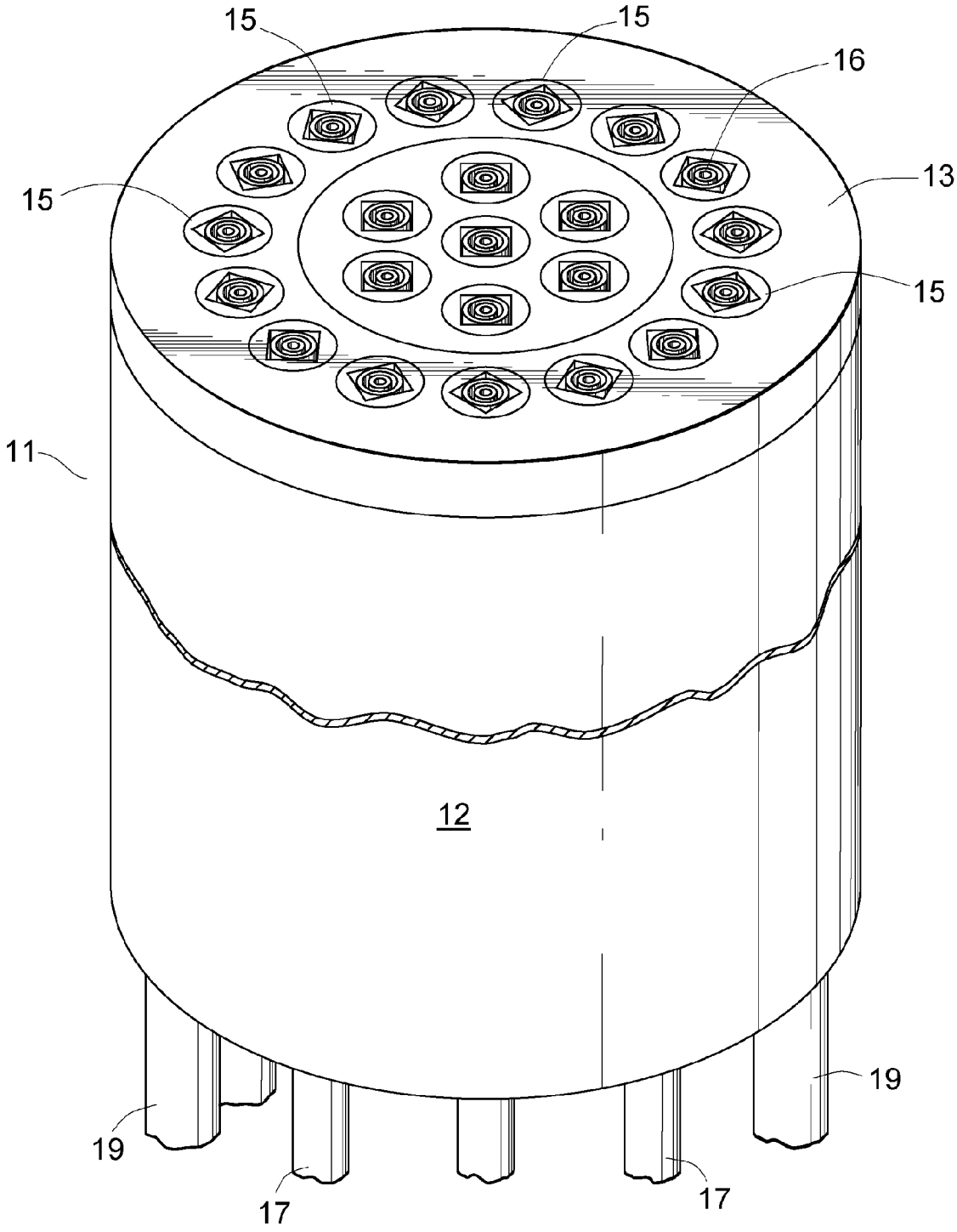
FIG. 3 is a top front isometric view of a burner head of the invention.

Referring now to FIG. 3, a burner employing the invention is shown. The burner 11 has a head portion 12 which includes a faceplate 13. The burner head produces a flame due to the combustion of mixed gases which emanate from jets 15 that are distributed around the faceplate in clusters. The jets include a plurality of concentric tubular members which extend downwardly through the burner head shown at 17 and 19. The construction of this embodiment of the invention is shown in more detail in FIG. 4.

Figure 4:
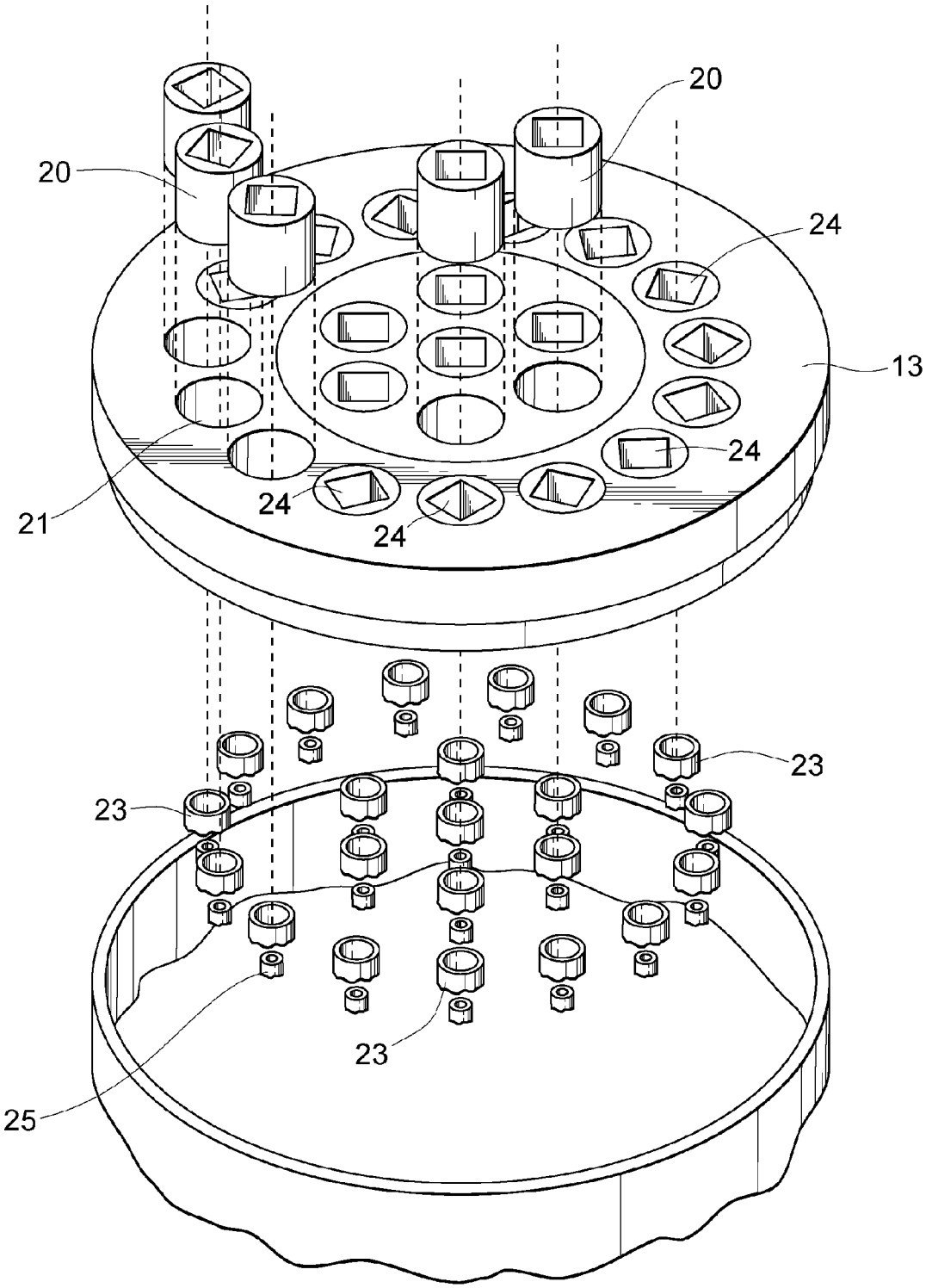
FIG. 4 is a top front isometric exploded view of the burner head shown in FIG. 3.
Figure 7A:
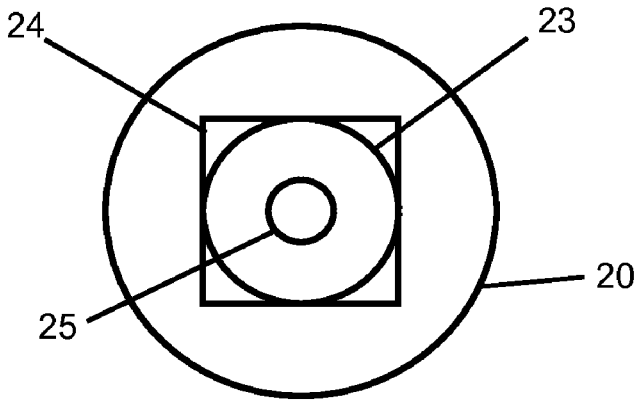
FIGS. 7*a, b* and *c* are diagrams showing gas jet configurations.

Referring now to FIG. 4, the alignment of the tubular gas jets provided by the inter-fitting of different geometric shapes is accomplished in part by inserts 20 fitted into the faceplate 13. The faceplate is drilled to provide holes 21 which receive a cluster of inserts. Each insert is identical as shown in this Figure and provides an economical tubular member of square internal cross-section 24. Nesting inside the square tube is a first inner-tubular member 23 having an outside diameter substantially equal to the inside width of the square. This is more clearly depicted diagrammatically in FIG. 7*a* and provides a laminar flow of two gases. For tri-laminar flow, yet smaller tubes 25 lie within tubes 23. In this example, tubes 25 are held coaxially within tubes 23 at their ends as is conventional in the art. Thus, the arrangement of gas jets provided by the above-described delivery tubes provides a concentric tri-laminar flow of three gases: a first jet being a group of four small channels bounded by the square aperture 24 of the insert 21 on the outside and the circular tube 23 on the inside; a second jet being provided by flow through tube 23 bounded on the inside by the outside surface of innermost tube 25; and a third jet being the unrestricted flow through tube 25.

Figure 5:
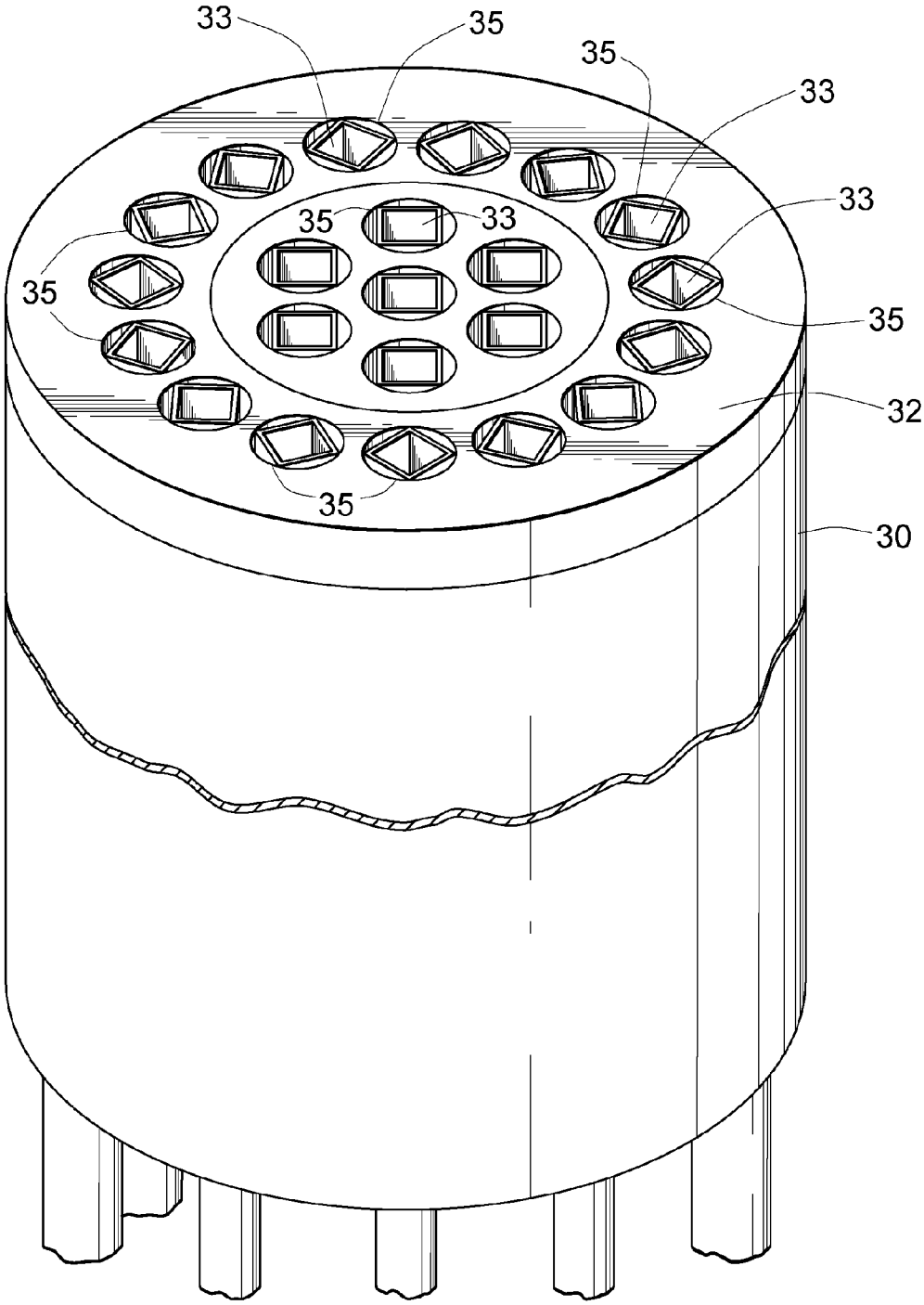
FIG. 5 is a top front isometric view of an alternate embodiment of the invention.
Figure 6:
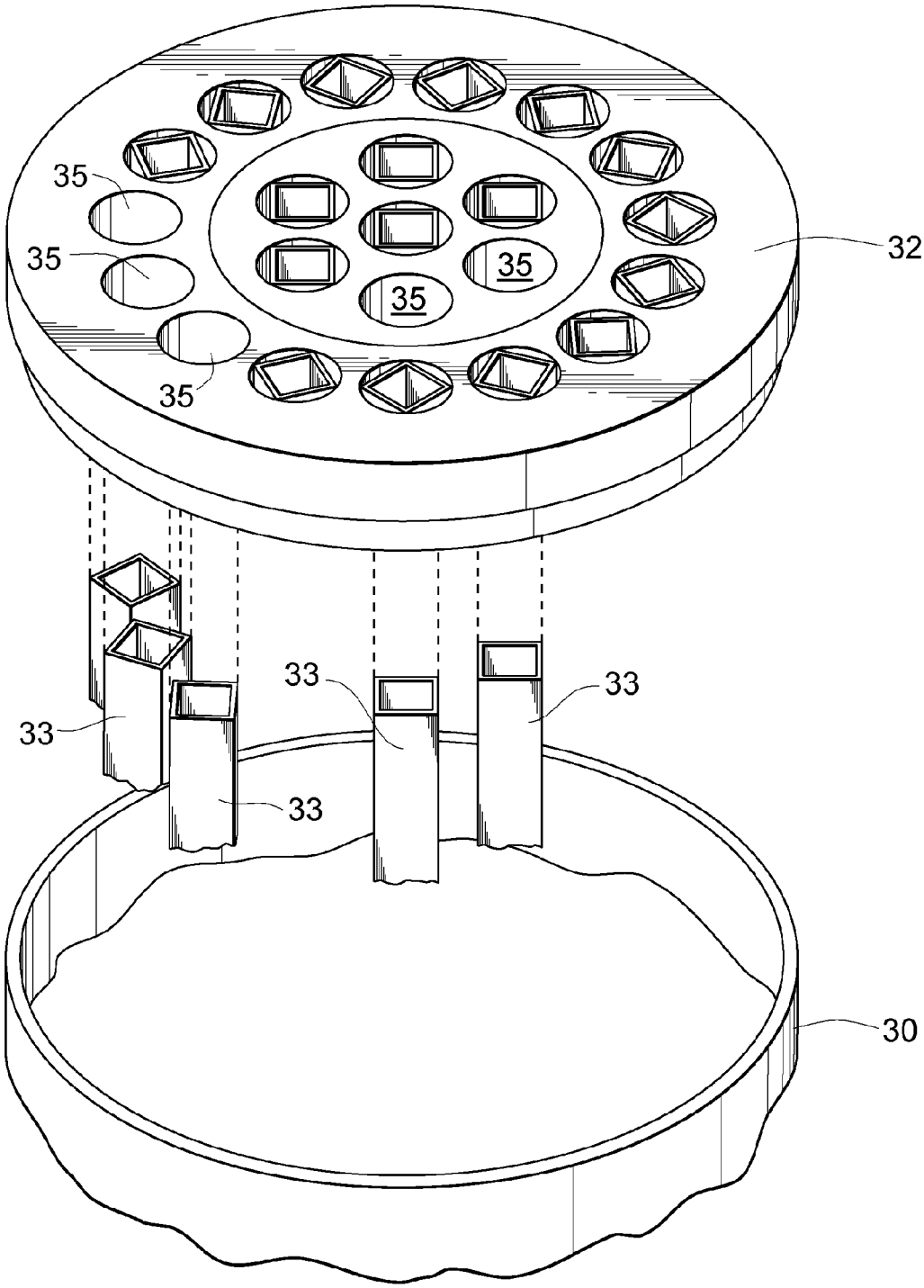
FIG. 6 is a top front isometric assembly view taken of the alternate embodiment shown in FIG. 5.
Figure 7B:
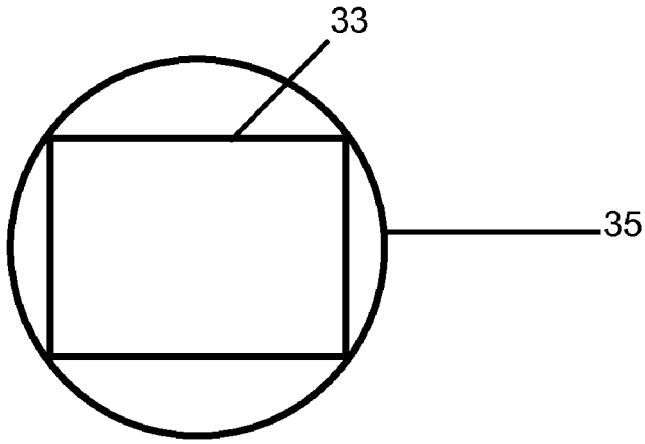

Another embodiment of the invention is shown in FIG. 5 which provides a dual flow burner head 30 constructed from inter-fitting square tubes 33 positioned within a cluster of drilled holes 35 in the faceplate 32. This construction is more economical than the previous embodiment. As shown in this Figure and depicted in FIG. 7*b*, the diagonal dimension of the square tube is approximately equal to the inside diameter of the faceplate hole. This provides an interference fit, or nesting, of the square tubes 33 within the faceplate holes 35 and provides an accurate coaxial alignment of the two fluid conduits formed by this arrangement. Namely, a first conduit is defined by the space within the faceplate hole 35 but around the periphery of the square tube 33, and a second conduit is the square tube itself. FIG. 6 depicts the alignment and placement of the tubes and the fitting of the tubes 33 within the faceplate holes 35 after the holes have been drilled. This construction is also shown diagrammatically in FIG. 7*b* which is like-numbered for reference to this second embodiment. A construction of this type is significantly advantageous when a large jet size ratio is desired. A small outer jet can be provided while maintaining precise symmetrical alignment with a much larger inner jet.

Figure 7C:
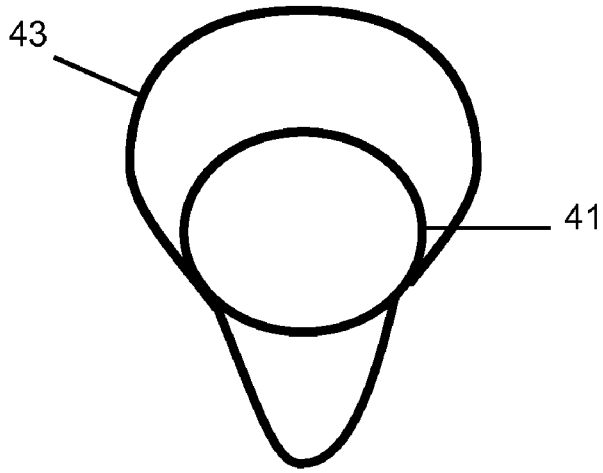

Referring now to FIG. 7*c*, yet other embodiments of the invention may employ the combination of different geometric shapes as desired. FIG. 7*c* depicts a circular tube 41 within a teardrop outer conduit 43 lying against its tapered side. The outer conduits can be formed by faceplate holes. Thus, the present invention lends itself to any combination of polygonal or arcuate shapes which utilize the principal of the nesting or contacting alignment between adjacent tubular members in order to ensure their consistent alignment throughout their longitudinal adjacency. As an added benefit, the direct contact of the tube provides heat transfer from the inner tubes thus significantly reducing the chance of overheating or carbon buildup.

Figure 1:
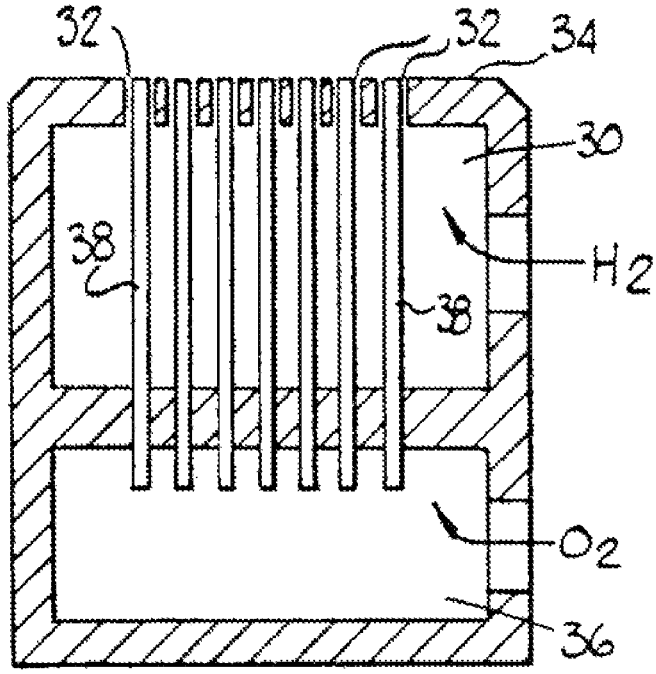
FIG. 1 (Prior Art)
FIG. 1 is a side elevation cross-section view of a prior art gas burner head.
Figure 2:
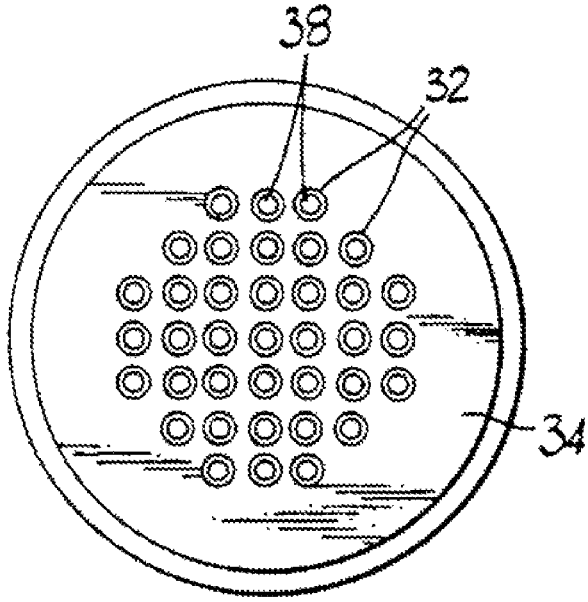
FIG. 2 (Prior Art)
FIG. 2 is a top plan view of the prior art burner head shown in FIG. 1.

The foregoing embodiments provide excellent flame characteristics while preserving the advantages of a quiet-running torch that also significantly reduces the chances of overheating or carbon buildup of the jets. By these constructions, assembly of the burners is easier to accomplish and lends itself to experimentation with different shapes to get an optimal gas oxygen combustion. Also, by using the faceplate to space the tubes, fewer jets may be used for increased efficiency and to control the flame characteristics. For example, a burner head utilizing twenty jets constructed according to the present invention is capable of providing a flame size requiring over twice the mount of jets making for a much more powerful, compact and efficient burner as compared to that of the prior art shown in FIGS. 1 and 2. By altering the shape and size of space around the jets on the faceplate, maximum laminar flow for the optimal mixing ratio of fuel and oxygen can be achieved. Also, most importantly, a wide range of flame characteristics may be achieved by varying the shape, size and placement of the jets. There is no limitation to the size or shape of the tubing, and any number of tubes may be used. Torches constructed according to the invention are not limited as to the type of fuel and may use liquid fuel or gas. The construction of the invention is not limited to surface mix torches but may also be applied to nozzle mix or premix torches. Furthermore, other types of fluids may be employed for different purposes, such as the nozzle heads used in snow making machines. The materials used in constructing the device of the invention can include metal, glass or ceramics.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. For example, the tube shape combinations are unlimited. The polygonal shapes can be hexagonal, triangular, etc. and the arcuate conduits can be of any shape desired.

What is claimed as being new and desired to be protected by Letters Patent of the United States is as follows:

1. A gas burner for producing a flame comprising:

a head portion including a faceplate being the terminus of a plurality of elongate axially aligned gas delivery tubes, at least two of said tubes delivering at least two different types of fuel to said faceplate; and a first tube having a first cross-sectional shape and a second tube having a second cross-sectional shape wherein longitudinal points along an inside wall of the first tube are in direct contact with longitudinal points along an outside wall of the second tube for maintaining the axial alignment of said tubes along their length wherein said first tube has a polygonal inside wall and a circular outside circumference, said first tube being a cylindrical insert closely fitted within a circular aperture of said faceplate.

2. The burner of claim 1 wherein the cross-sectional shape of said first tube is a circle.

3. The burner of claim 1 wherein the cross-sectional shape of said first tube is a square and said second tube is a circle.

4. The burner of claim 1 further including a third tube coaxially aligned with and located within said second tube which in turn lies within said first tube.

5. The burner of claim 1 wherein both of said types of fuels are gases.

* * * * *